US010665994B2

(12) United States Patent
Wittmann

(10) Patent No.: US 10,665,994 B2
(45) Date of Patent: May 26, 2020

(54) MULTIPLE-CONTACT PLUG WITH AN INTEGRATED SHORT-CIRCUIT LINK ELEMENT

(71) Applicant: Robert Bosch GmbH, Stuttgart (DE)

(72) Inventor: Rolf Wittmann, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/327,987

(22) PCT Filed: Jul. 28, 2017

(86) PCT No.: PCT/EP2017/069140

§ 371 (c)(1),
(2) Date: Feb. 25, 2019

(87) PCT Pub. No.: WO2018/036750

PCT Pub. Date: Mar. 1, 2018

(65) Prior Publication Data

US 2019/0229474 A1 Jul. 25, 2019

(30) Foreign Application Priority Data

Aug. 23, 2016 (DE) ..... 10 2016 215 791

(51) Int. Cl.
*H01R 13/703* (2006.01)
*H01R 13/432* (2006.01)
*H01R 25/16* (2006.01)

(52) U.S. Cl.
CPC ..... *H01R 13/7031* (2013.01); *H01R 13/432* (2013.01); *H01R 13/7032* (2013.01); *H01R 25/16* (2013.01)

(58) Field of Classification Search
CPC ..... H01R 13/7031; H01R 13/432; H01R 13/7032
See application file for complete search history.

(56) References Cited

U.S. PATENT DOCUMENTS 4,582,376 A 4/1986 Olsson
4,635,355 A * 1/1987 Brinkman ..... H01R 43/22 29/747

(Continued)

FOREIGN PATENT DOCUMENTS

DE 91 12 178 U1 7/1992
EP 0678942 A1 10/1995

(Continued)

OTHER PUBLICATIONS

International Search Report for PCT/EP2017/069140, dated Oct. 13, 2017.

*Primary Examiner* — Abdullah A Riyami
*Assistant Examiner* — Nader J Alhawamdeh
(74) *Attorney, Agent, or Firm* — Norton Rose Fulbright US LLP; Gerard Messina

(57) ABSTRACT

A multiple-contact plug and a plug connector system equipped therewith are described. The multiple-contact plug has a plug housing having contact receiving chambers and a plurality of contacts that are each inserted into one of the contact receiving chambers. The contacts are each formed having a contact base body and an elastically deflectable primary lance protruding laterally from this contact base body, which lance is elastically reversibly deflectable from an outward-protruding position into a position deflected toward the contact base body. The multiple-contact plug in addition has at least one short-circuit jumper element. Electrically conductive contact surfaces of the short-circuit jumper element are situated in at least two of the contact receiving chambers and are electrically conductively connected. The contact surfaces are situated in the contact receiving chambers at positions such that they are each contacted by the primary lance, in its protruding position, of a contact fixed in the respective contact receiving chamber. On a mating plug, a short-circuit separating element can then (Continued)

be fashioned such that, in a plugged-together state, it displaces the primary lance of at least one contact from the protruding position into the deflected position, and in so doing interrupts the electrical contact between the primary lance and the contact surface of the short-circuit separating element.

16 Claims, 4 Drawing Sheets

(56) References Cited

U.S. PATENT DOCUMENTS

| | | | | |
|---|---|---|---|---|
| 9,112,294 | B2 * | 8/2015 | Pade | H01R 13/436 |
| 9,130,294 | B2 * | 9/2015 | Schmatz | H01R 13/432 |
| 2007/0232141 | A1 * | 10/2007 | Tyler | H01R 9/031 439/595 |
| 2014/0099841 | A1 * | 4/2014 | Schmatz | H01R 13/432 439/872 |
| 2016/0190750 | A1 * | 6/2016 | Shinmi | H01R 13/7032 439/188 |

FOREIGN PATENT DOCUMENTS

| | | | | |
|---|---|---|---|---|
| EP | 1926183 | A2 | 5/2008 | |
| JP | H103972 | A | 1/1998 | |
| WO | 2008150523 | A2 | 12/2008 | |
| WO | WO-2008150523 | A2 * | 12/2008 | H01R 13/6273 |

* cited by examiner

MULTIPLE-CONTACT PLUG WITH AN INTEGRATED SHORT-CIRCUIT LINK ELEMENT

FIELD OF THE INVENTION

The present invention relates to a multiple-contact plug having an integrated short-circuit jumper element. In addition, the present invention relates to a plug connector system having such a multiple-contact plug and a mating plug.

BACKGROUND INFORMATION

In a wide variety of technical contexts of use, electrical lines often have to be connected to one another. For example, in automotive engineering electrical lines coming from vehicle components have to be connected to electrical lines of other vehicle components or of, for example, a control device. A plurality of electrical lines are often combined to form a cable harness.

In order to enable the connection of as many electrical lines as possible to a plurality of other electrical lines in a simple manner, multiple-contact plugs are often provided, which can be plugged to one or more mating plugs. Such multiple-contact plugs are sometimes also referred to as cable harness plugs. In such a multiple-contact plug, a plurality of contacts are provided, each of the contacts being connected as a rule to an electrical line. The contacts are housed in a plug housing. Here the contacts are configured in such a way that when the plug housing is plugged together with a housing of the mating plug, or housings of the mating plugs, the contacts are brought into electrical contact with mating contacts situated there. By producing a plug connection between the multiple-contact plug and one or more mating plugs, in this way the electrical lines attached to their contacts or mating contacts can be electrically connected to one another.

In plug connector systems that are to be used for particular, often safety-relevant, purposes, so-called short-circuit jumpers are sometimes provided. A short-circuit jumper works in such a way that when the plug connection is detached, i.e. the mating plug is pulled apart from the multiple-contact plug, two of the contacts provided in the multiple-contact plug are deliberately short-circuited. A resulting short-circuit can be recognized for example by a control unit that monitors one of the respective lines.

Such a functionality can be required for example for plug connections by which an airbag is to be connected electrically to other components, for example to a control device in a vehicle. Via the contacts deliberately short-circuited when the plug connection is detached, in this case a circuit for the triggering of an airbag detonator capsule is closed, thus preventing accidental triggering of the airbag.

An example of a plug having a short-circuit jumper is described in German Utility Model No. 91 12 178 U1.

SUMMARY

Specific embodiments of the present invention can advantageously enable a multiple-contact plug or a plug connector system in which deliberate short-circuits between contacts can be brought about in a constructively simple manner when a plug connection is detached.

According to a first aspect of the present invention, a multiple-contact plug is proposed that has a plug housing having a plurality of contact receiving chambers formed therein as well as a plurality of contacts, a respective contact being pushed into one of the contact receiving chambers in a direction of insertion and fixed therein. The contacts are each formed having a contact base body and an elastically deflectable primary lance that protrudes laterally from this contact base body, the primary lance being elastically reversibly deflectable from an outward-protruding position into a position deflected toward the contact base body. The multiple-contact plug is distinguished in that in addition it has at least one specific short-circuit jumper element. Electrically conductive contact surfaces of the short-circuit jumper element are situated in at least two of the contact receiving chambers, a contact surface situated in a first contact receiving chamber being electrically conductively connected to a contact surface situated in a second contact receiving chamber. The contact surfaces of the short-circuit jumper element are situated in the contact receiving chambers at positions such that they are each contacted by the primary lance, in its protruding position, of a contact fixed in the respective contact receiving chamber.

According to a second aspect of the present invention, a plug connector system is proposed that has a multiple-contact plug according to a specific embodiment of the first aspect of the present invention as well as a mating plug that is capable of being plugged together with the multiple-contact plug and that has one or more mating contacts that, in a plugged-together state of the multiple-contact plug with the mating plug, each come into electrical contact with a respectively associated one of the contacts. On the mating plug, there is fashioned a short-circuit separating element that is designed and configured such that, in the plugged-together state, it displaces the primary lance of at least one contact from the protruding position into the deflected position, or in the direction toward the deflected position, and in so doing interrupts the contact between the primary lance and the contact surface of the short-circuit separating element.

Ideas concerning specific embodiments of the present invention can also, inter alia, be regarded as based on the ideas and findings described below.

In conventional multiple-contact plugs, or plug connector systems formed therewith, short-circuit jumpers are often formed with the aid of separate metal springs that for example press on outer sides of a contact pin when the plug connection is open. When the plug connection is closed, for example a shaped part or slide provided on the mating plug slides between the short-circuit jumper and the surface of the contact pin, and in this way interrupts the short-circuit. Because in this case the short-circuit jumper is realized in the manner of a spring, additional constructive space inside the multiple-contact plug is required for the spring path that it has to travel during deflection. Such constructive space is particularly tight in particular in the case of miniaturization of components of a plug connector system. Moreover, a short-circuit jumper realized as a metal spring is usually a stamped bending part that requires a relatively large outlay.

In contrast to this, in the multiple-contact plug proposed here, the short-circuit jumper element provided therein can be a very simple component, for example a simple sheet metal part, that does not have to be bent, or in any case has to be bent only in a few steps, and/or requires minimal constructive space.

The underlying idea can here be regarded as being that in the multiple-contact plug proposed here the short-circuit jumper element itself does not have to have an elastically springy property. Instead, the fact is to be exploited that the contacts that are to be received in the contact receiving chambers of the housing of the multiple-contact plug in many cases are equipped with an elastically springy element in the form of an elastically reversibly deflectable primary lance. Due to its outward-springing property, this primary lance can be used to form an electrical connection with the short-circuit jumper element, which is stationary and which itself is not necessarily flexibly displaceable.

The primary lance, which in some cases can also be referred to as a primary locking lance, in the unloaded state generally protrudes obliquely downward, i.e. opposite a direction of insertion along which the respective contact is to be pressed into a contact receiving chamber that receives it, from a contact base body that is for example box-shaped. When force is applied toward the contact base body, the primary lance can however be deflected toward the contact base body in elastically reversible fashion.

In general, the primary lance is used to lock the contact at least temporarily or provisionally inside the contact receiving chamber that receives it, in particular during an equipping of the plug housing with a plurality of contacts, before, at a later time, fixing the contact in the contact receiving chamber, usually with the aid of a secondary securing device. During introduction into the contact receiving chamber, the primary lance is first deflected in and then, when a target position is reached, is again deflected outward, in the direction of the outward-protruding position, into an opening adjoining the contact receiving chamber, while becoming supported on an adjoining undercut, thus enabling the contact to be locked in the desired position.

It is now proposed to make use of the elastically springy property of the primary lance, going beyond its original purpose, to detect a detachment of the multiple-contact plug on the one hand and of a mating plug on the other hand (i.e. the separation of the multiple-contact plug and mating plug from one another) in that a deliberate short-circuit is here produced. For this purpose, the short-circuit jumper element mentioned above is provided in the multiple-contact plug.

This short-circuit jumper element has at least two contact surfaces formed thereon. The short-circuit jumper element is designed and situated in such a way that each of the two contact surfaces extends into one of the contact receiving chambers in the plug housing. The short-circuit jumper element with its contact surfaces is designed and configured such that each of the contact surfaces inside the associated contact receiving chamber is situated at a position at which the primary lance of the contact locked in this contact receiving chamber can press against the respective contact surface, for example with a part of the primary lance protruding furthest from the contact base body. In this way, the primary lance of the contact comes into mechanical contact, and thus also into electrical connection, with the contact surface of the short-circuit jumper element.

The short-circuit jumper element is designed such that this is the case for at least two contacts locked in different contact receiving chambers, so that the two contacts are electrically connected to one another, and thus short-circuited, via their primary lances lying against the contact surfaces of the short-circuit jumper element.

The named short-circuit between at least two contacts in the multiple-contact plug occurs whenever the multiple-contact plug is not connected to a corresponding mating plug. However, as soon as a correspondingly fashioned mating plug of a plug connector system is plugged together with the multiple-contact plug, the short-circuit is to be interrupted.

For this purpose, a for example slide-type short-circuit separating element is provided on the mating plug. This element typically extends from an end face of the mating plug and is designed such that it engages in the multiple-contact plug at a suitable position, thus interrupting the short-circuit.

Here, the short-circuit separating element can for example be pushed between the primary lance of the contact and the contact surface of the short-circuit upper element, and can thereby move the primary lance away from the contact surface, i.e. towards its deflected position.

The separation thereby brought about of the short-circuit can for example produce a signal that can be interpreted by a control unit, or, alternatively, can cause a circuit to be opened. In the example named above, in this way for example the airbag to be contacted by the multiple-contact plug can be switched "sharp."

According to a specific embodiment, the short-circuit jumper element is attached in a fixed position on the plug housing.

In other words, the short-circuit jumper element can be attached fixedly and immovably on the plug housing. In particular, the short-circuit jumper element does not have to be a component that can be displaced, for example deflected, relative to the plug housing. Instead, the short-circuit jumper element can be fastened rigidly on the plug housing, for example glued, screwed, or riveted thereon or cast in an injection-molded plug housing. In particular, the short-circuit jumper element can be fixed on the plug housing in such a way that its contact surfaces are brought to lie against respective inner surfaces of the plug housing, preferably rigidly and immovably, and from there they can be contacted by the outwardly springing primary lances of received contacts.

According to a specific embodiment, the short-circuit jumper element is made in one piece.

In other words, the short-circuit jumper element can be provided as a component that is as simple as possible, not assembled from a plurality of parts but rather fashioned as a single component. For example, the short-circuit jumper element can be realized as a sheet metal part stamped in a suitable shape. The short-circuit jumper element can preferably be flat; i.e. it does not necessarily need to be bent into a suitable shape.

In particular, according to a specific embodiment the short-circuit jumper element can be a one-piece metal plate component of which partial areas are each situated in one of the contact receiving chambers as one of the contact surfaces. The contact surfaces here can for example extend into the contact receiving chambers from one side. The contact surfaces connected to one another by the short-circuit jumper element can be situated in adjacent contact receiving chambers. The contact receiving chambers can however also be not adjacent but rather situated further from one another; in this case the short-circuit jumper element should be made with a suitable geometry for connecting to one another electrically the contact surfaces accommodated in the contact receiving chambers situated at a distance from one another.

Alternatively, the short-circuit jumper element can also be made more complex. For example, two or more contact surfaces can be formed on separate components, for example sheet metal parts, and the components can be electrically connected to one another by any electrically conductive construction, which can be made in one part or in multiple parts.

According to a specific embodiment, the contact receiving chamber has an undercut that grasps the primary lance from behind in its protruding position in order to lock the contact in the contact receiving chamber, the respective contact surface of the short-circuit jumper element being situated in a region of the contact receiving chamber adjacent to the undercut, preferably downstream from the undercut in the direction of insertion.

In other words, it is regarded as advantageous to configure the contact surfaces of the short-circuit jumper element and the respective contact receiving chambers in such a way that these surfaces are situated at or close to the undercut on which the primary lance is to be supported in its protruding position, in order to lock the contact in the respective contact receiving chamber. This takes into account the fact that the primary lance is in most cases designed such that it extends furthest away from the contact base body close to the undercut, in order to be able to be supported on the undercut. It is therefore advantageous to situate the contact surfaces of the short-circuit jumper element at the location to which the primary lance of the inner surface of the contact receiving chamber comes closest or against which it is pressed, i.e. close to the undercut, in particular slightly downstream from the undercut, relative to the direction of insertion.

Here, the term "downstream" is used only to describe a relative situation with regard to the direction of insertion. It is not to be understood as referring to an electrical current. The same holds analogously for the term "upstream."

According to a specific embodiment, the short-circuit jumper element covers at least some regions of a surface of the undercut. The short-circuit jumper element, made for the most part of mechanically resistant metal, can in this way mechanically reinforce the surface of the undercut, and protect the plug housing, made mostly of plastic, in this region, for example against being damaged by the primary lance.

According to a specific embodiment, the contact surfaces of the short-circuit jumper element have a coating. The coating can for example be realized as a metallic layer. Particularly preferably, the coating is realized as a noble metal layer. Such a noble metal layer, for example a thin gold layer covering the contact surface, can help to reduce a contact resistance between the contact surface and a primary lance lying against it. In addition, corrosion on the contact surface can be avoided. Alternatively, the metallic layer can also be formed by a non-noble metal, such as tin. In another alternative, the coating can be made of a material having good electrical conductivity, e.g. carbon nanotubes or carbon.

According to a specific embodiment, the contact surfaces of the short-circuit jumper element are positioned in the contact receiving chambers in such a way that the primary lance of a contact, in its protruding position, contacts the respective contact surface only when the contact is positioned in a specified manner inside the contact receiving chamber.

In other words, the contact surfaces of the short-circuit jumper element can be specifically designed and situated such that the contact surfaces are not situated arbitrarily in the respective contact receiving chambers, but rather are situated at specific positions provided for this purpose. These positions can be selected such that one of the contact surfaces is reached and contacted by the primary lance of the contact only when the contact is situated in a desired position inside the contact receiving chamber. In this way, the occurrence of a short-circuit caused by the primary lance lying against the contact surface, for example during the equipping of a multiple-contact plug, can be taken as an indication that the contact has been correctly received in the contact receiving chamber and locked therein.

According to a specific embodiment, a cable is electrically conductively attached to the contact base body, and the contact base body is electrically conductively connected to the primary lance.

For example, on the contact base body there can be provided a crimp region onto which a stripped end of the cable can be crimped. The contact base body itself can be made of an electrically conductive material, in particular metal, for example in the form of a stamped and/or bent metal sheet. The primary lance can be electrically connected to the contact base body, or can even be made in one piece therewith. In this way, the cable is electrically connected to the primary lance, and short-circuits caused by the primary lance can be detected via the cable.

According to a specific embodiment, on the contact base body there is formed a mating contact receptacle for electrically connective interaction with a mating contact of a mating plug, and the mating contact receptacle is connected electrically conductively to the primary lance.

The mating contact receptacle can be integrated into the contact base body. It can for example be formed having contact blades that can be contacted by the mating contact. Because the mating contact receptacle is electrically connected to the primary lance, and may even be made in one piece therewith, in the form of a common bent stamped bending part, short-circuits brought about via the primary lance can also be detected at the mating contact.

It is to be noted that some of the possible features and advantages of the present invention are described herein in part with reference to a multiple-contact plug and in part with reference to a plug connector system. The person skilled in the art will recognize that the features can be combined, transferred, adapted, or exchanged in a manner suitable for arriving at further specific embodiments of the present invention.

BRIEF DESCRIPTION OF THE DRAWINGS

In the following, specific embodiments of the present invention are described with reference to the accompanying drawings; neither the drawings nor the description are to be interpreted as limiting the present invention.

The Figures are schematic and are not to scale. In the Figures, identical reference characters designate features that are identical or that have identical function.

DETAILED DESCRIPTION

Figure 1:
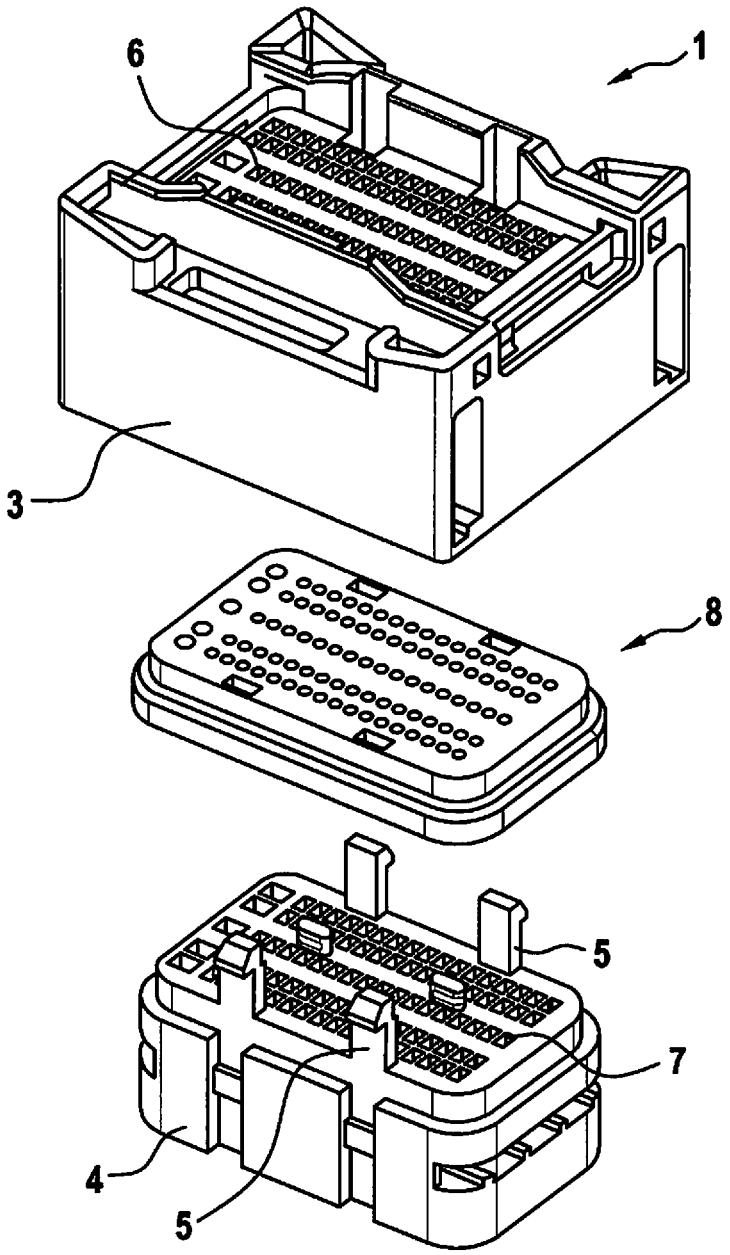
FIG. 1 shows a perspective view of components of a multiple-contact plug.

FIG. 1 shows components of a multiple-contact plug 1 that may be part of a plug connection to a mating plug. Multiple-contact plug 1 can for example be used for the mechanical and electrical connection of a plurality of cables to one another or of a cable harness to a control device of a motor vehicle.

Multiple-contact plug 1 has a plug housing 2 having a housing upper part 3 and a housing lower part 4 that can be mechanically connected to one another via locking clips 5. A mat seal 8 is situated between housing upper part 3 and housing lower part 4. Contact receiving chambers 6, 7 are provided both in housing upper part 3 and in housing lower part 4, through which chambers cables and contacts fastened thereon (not shown in FIG. 1) can be introduced into multiple-contact plug 1 and fastened there in locking fashion.

Figure 2:
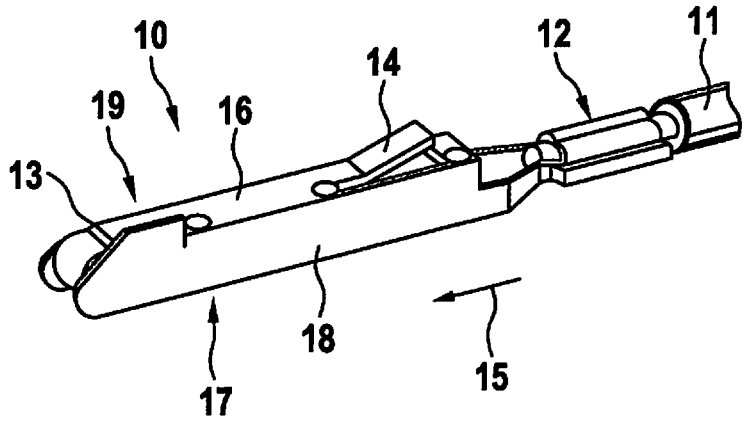
FIG. 2 shows a perspective view of a contact to be received in a multiple-contact plug.

FIG. 2 shows a contact 10 that can be placed into a contact receiving chamber 7 of a multiple-contact plug 1 and locked therein. Here, a contact base body 13, in the form of a contact box that is approximately cuboidal, is provided at a front part of contact 10. The contact box has an upper wall 16, a lower wall 17, and two side walls 18, 19 situated opposite one another. At the rear end of contact 10, a cable 11 is fastened to contact 10 via a crimp region 12.

On upper wall 16 of contact base body 13, a primary lance 14 is provided that protrudes obliquely toward the rear and outward, opposite a direction of insertion 15, and extends over upper wall 16. This primary lance 14 is connected in one piece, at a proximal end, to upper wall 16 of contact base body 13, and at a distal end is self-supported, and, due to the elastic properties of the metal sheet that forms the contact, can be flexibly displaced inward, towards contact base body 13, from a protruding base position into a deflected position.

When no force is applied, primary lance 14 protrudes outward, in the outwardly protruding position. However, when contact 10 is inserted into a contact receiving chamber 7, primary lance 14 is briefly and elastically reversibly pressed inward, in springing fashion, toward contact base body 13, and when an end position is reached it moves outward in springing fashion so as to lock into a recess provided there inside contact receiving chamber 7.

Figure 3:
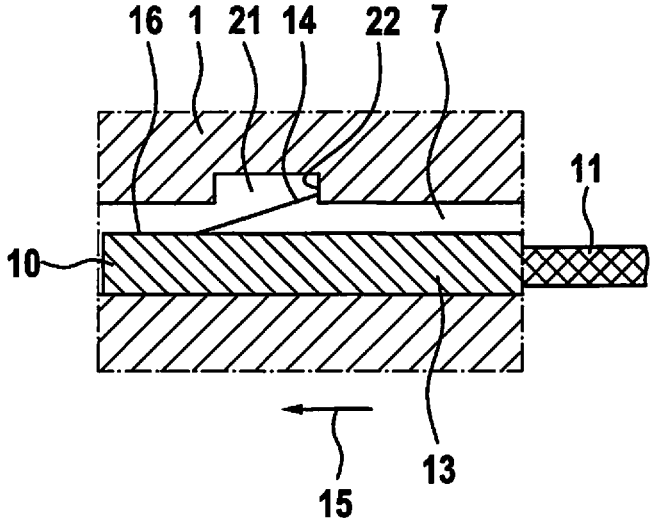
FIG. 3 shows a simplified sectional view of a contact received in a multiple-contact plug.

FIG. 3 shows, in cross-section, how a contact 10 is locked in a contact receiving chamber 7 of a plug 1. Primary lance 14 protruding from upper wall 16 engages in a recess 21 provided in contact receiving chamber 7, and is supported on an undercut 22, against direction of insertion 15.

Figure 4:
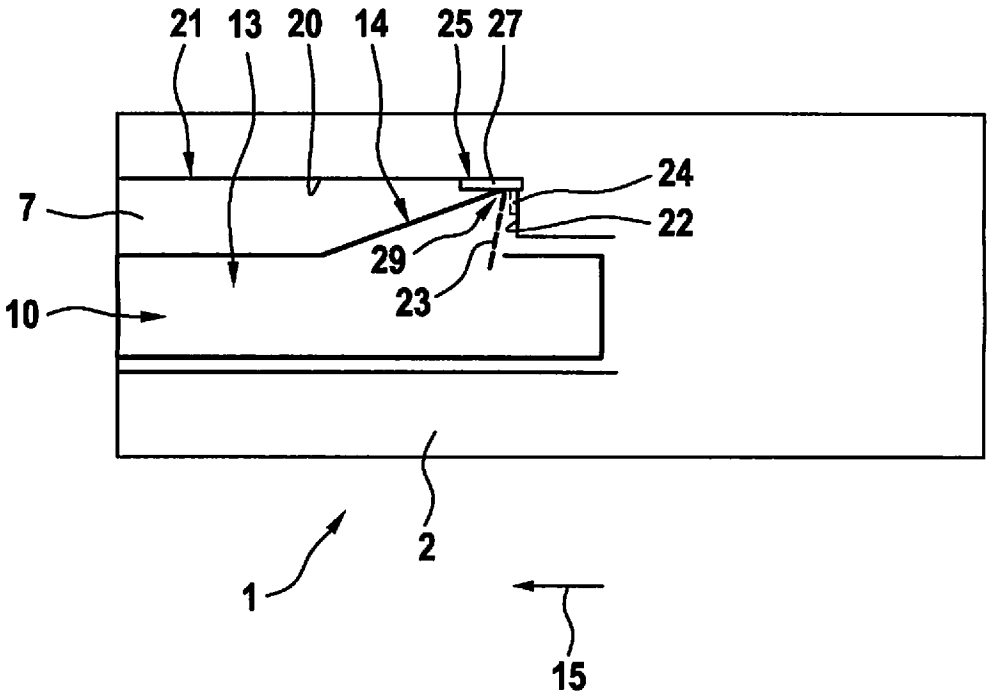
FIG. 4 shows a simplified sectional view of a multiple-contact plug according to a specific embodiment of the present invention, in which a contact is received.
Figure 5:
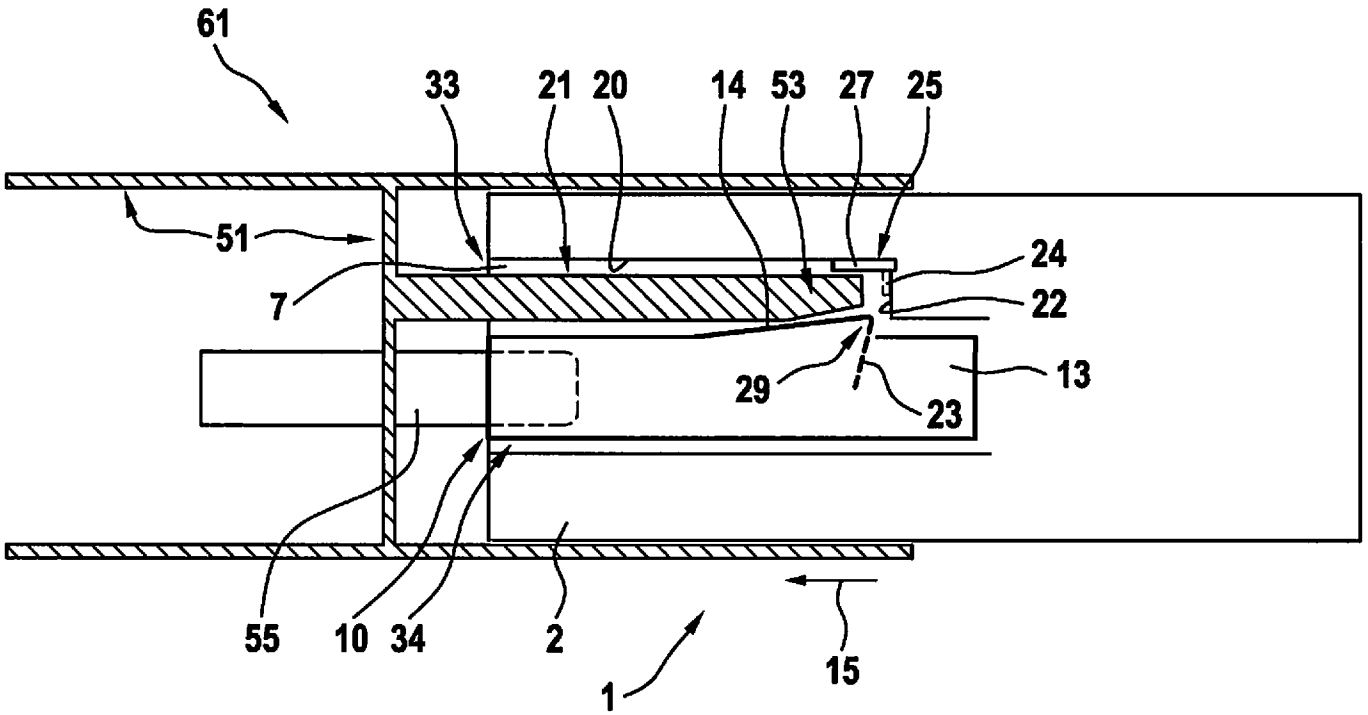
FIG. 5 shows the multiple-contact plug of FIG. 4 in a state in which it is plugged together with a mating plug.

FIGS. 4 and 5 show a specific embodiment of a multiple-contact plug 1 according to the present invention. For clarity, inessential details, such as crimp region 12 or a cable 11 attached thereto, are not shown. In FIG. 4, multiple-contact plug 1 is shown in a state in which it is not coupled to a mating plug. In FIG. 5, in contrast, multiple-contact plug 1 is shown in a state in which it is coupled to a mating plug 51, as plug connector system 61. Details of mating plug 51 are shown only schematically, for reasons of clarity.

In plug housing 2 of multiple-contact plug 1, a contact surface 27 of a short-circuit jumper element 25 is situated on an inner wall 20, situated opposite contact 10, of contact receiving chamber 7, in the region of the recess 21 provided therein. Contact surface 27 is situated close to undercut 22, and is thus situated at the location where a furthest-protruding part 29 of primary lance 14 extends toward oppositely situated inner surface 20 when primary lance 14 is in its protruding position. The furthest-protruding part 29 of primary lance 14 can therefore come to lie against the respective contact surface 27 as soon as contact 10 has been inserted into contact receiving chamber 7 in direction of insertion 15 and correctly locked there.

Contact surface 27 situated in contact receiving chamber 7 can be electrically connected, via other regions of short-circuit jumper element 25, to a second contact surface 27 that is situated in another contact receiving chamber 7, where it is contacted by primary lance 14 of contact 10 situated there. In this way, the two contacts 10 are electrically connected to one another in short-circuiting fashion via short-circuit jumper element 25 and primary lances 14 lying against its contact surfaces 27. Such a short-circuit can for example be detected externally, or can close an external circuit.

FIG. 5 shows multiple-contact plug 1 in a state in which it is plugged together with a mating plug 51. Multiple-contact plug 1 and mating plug 51 are designed to match one another in such a way that mating contacts 55 of mating plug 51 can each interact with associated contacts 10 of multiple-contact plug 1, and can bring about an electrical contact between them. For example, mating contact 55 can interact with a mating contact receptacle 34 provided in contact base body 13. Mating contact 55 can be designed for example as a plug-type pin, and can engage in a mating contact receptacle 34 designed in the manner of a socket. In addition, multiple-contact plug 1 and mating plug 51 are designed so as to be matched to one another in such a way that they can be coupled to one another in mechanically stable fashion.

A specific short-circuit separating element 53 is provided on mating plug 51. In the depicted example, this short-circuit separating element 53 extends in the manner of a pin or slide in a direction of plugging together, which is thus opposite to direction of insertion 15, from mating plug 51 towards multiple-contact plug 1. During plugging, short-circuit separating element 53 engages in a disassembly opening 31 provided in plug housing 2 of multiple-contact plug 1, which inter alia is provided to press primary lance 14 downward, using a disassembly tool, towards contact base body 13 in order to enable contact 10 to be unlocked in order to disassemble it from plug housing 2. Short-circuit separating element 53 slides between primary lance 14 and oppositely situated inner wall 20 of contact receiving chamber 7, and in this way presses primary lance 14 towards contact base body 13, i.e. into its deflected position. In this way, the electrical connection between primary lance 14 and contact surface 27 of short-circuit jumper element 25 is separated, and thus a previously existing short-circuit to one of the other contacts 10 of multiple-contact plug 1 is interrupted.

In order to achieve adequate mechanical stability of short-circuit separating element 53, this element can be made of a stable material, in particular metal, for example steel. Here, a geometry of short-circuit separating element 53 should be suitably chosen such that short-circuit separating element 53 is not itself responsible for an electrical connection between primary lance 14, pressed down by said element, and contact surface 27 of short-circuit jumper element 25.

Alternatively, short-circuit separating element 53 can be made of an electrically non-conductive material, for example plastic, or can be coated externally with such a material.

If short-circuit separating element 53 is electrically conductive, and for example is electrically connected to the associated mating contact 55, then, given adequate electrical conductivity of short-circuit separating element 53, an additional conductive path for additional contact security may even be provided.

The fact that short-circuit separating element 53, in the plugged-together state, displaces primary lance 14 at least partly toward contact base body 13, thus reducing or completely removing a supporting of primary lance 14 on undercut 22, can as a rule be accepted, because primary lance 14 generally has to secure contact 10 only temporarily during the equipping of contact receiving chambers 7, while, after all contact receiving chambers 7 have been equipped, contacts 10 are however generally fixed in contact receiving chambers 7 by a separate secondary securing (not shown).

Primary lance 14 can have, close to its self-supporting end, i.e. distal to the furthest-protruding region 29, a region 23 (shown in dashed lines) that is offset inwardly toward contact base body 13.

In addition, short-circuit jumper element 25 can be designed such that with a protective region 24 (shown in dashed lines) it covers at least parts of the surface of undercut 22, thus protecting this surface from being damaged mechanically by primary lance 14.

The design described herein can also be used for equipable blade contacts having primary lances.

What is claimed is:

1. A multiple-contact plug, comprising:

a plug housing having a plurality of contact receiving chambers formed therein;

a plurality of contacts, wherein:

each contact includes a contact base body and an elastically deflectable primary locking lance that protrudes outwardly from the contact base body, the primary locking lance is elastically reversibly deflectable from an outward-protruding position into a position deflected towards the contact base body, and each of the contacts is inserted into one of the contact receiving chambers in a direction of insertion and fastened therein, wherein the primary locking lance is configured to lock, in its outward-protruding position, the contact in the contact receiving chamber that receives it; and at least one short-circuit jumper element, wherein:

electrically conductive contact surfaces of the at least one short-circuit jumper element are situated in at least two of the contact receiving chambers, a contact surface situated in a first contact receiving chamber is electrically conductively connected to a contact surface situated in a second contact receiving chamber, and the contact surfaces of at least one short-circuit jumper element are situated in the contact receiving chambers at positions such that the contact surfaces are each contacted by the primary locking lance, in the protruding position thereof, of a contact fixed in the respective contact receiving chamber.

2. The multiple-contact plug as recited in claim 1, wherein the at least one short-circuit jumper element is attached in a positionally fixed manner on the plug housing.

3. The multiple-contact plug as recited in claim 1, wherein the at least one short-circuit jumper element is made in one piece.

4. The multiple-contact plug as recited in claim 1, wherein the at least one short-circuit jumper element is a one-piece metal sheet component of which partial regions are each situated in one of the contact receiving chambers as one of the contact surfaces.

5. The multiple-contact plug as recited in claim 1, wherein the contact receiving chambers include an undercut, which the primary locking lances of the contacts grasp from behind in their protruding position to lock the contacts in the contact receiving chambers, and wherein the respective contact surface of the at least one short-circuit jumper element is situated in a region of the contact receiving chamber adjacent to the undercut.

6. The multiple-contact plug as recited in claim 5, wherein the respective contact sensor is situated downstream from the undercut in the direction of insertion.

7. The multiple-contact plug as recited in claim 5, wherein the at least one short-circuit jumper element covers a surface of the undercut at least in some regions.

8. The multiple-contact plug as recited in claim 1, wherein the contact surfaces of the at least one short-circuit jumper element have a coating.

9. The multiple-contact plug as recited in claim 8, wherein the coating is a metallic coating.

10. The multiple-contact plug as recited in claim 9, wherein the metallic coating is a noble metal coating.

11. The multiple-contact plug as recited in claim 1, wherein:

the contact surfaces of the at least one short-circuit jumper element are positioned in the contact receiving chambers so that the primary locking lance, in the protruding position, of a contact contacts the respective contact surface only when the contact is positioned in a specified manner inside the contact receiving chamber.

12. The multiple-contact plug as recited in claim 1, further comprising:

a cable electrically conductively attached to the contact base bodies, wherein the contact base bodies are electrically conductively connected to the primary locking lance.

13. The multiple-contact plug as recited in claim 1, further comprising:

a mating contact receptacle for achieving an electrically connective interaction with a mating contact of a mating plug, wherein the mating contact receptacle is configured on the contact base body, and wherein the mating contact receptacle is connected electrically conductively to the primary locking lance.

14. A plug connector system, comprising:

a multiple-contact plug, including:

a plug housing having a plurality of contact receiving chambers formed therein;

a plurality of contacts, wherein:

each contact includes a contact base body and an elastically deflectable primary locking lance that protrudes laterally from the contact base body, the primary locking lance is elastically reversibly deflectable from an outward-protruding position into a position deflected towards the contact base body, each of the contacts is inserted into one of the contact receiving chambers in a direction of insertion and fastened therein; and at least one short-circuit jumper element, wherein:

electrically conductive contact surfaces of the at least one short-circuit jumper element are situated in at least two of the contact receiving chambers, a contact surface situated in a first contact receiving chamber is electrically conductively connected to a contact surface situated in a second contact receiving chamber, and the contact surfaces of the at least one short-circuit jumper element are situated in the contact receiving chambers at positions such that the contact surfaces are each contacted by the primary locking lance, in the protruding position thereof, of a contact fixed in the respective contact receiving chamber;

a mating plug that can be plugged together with the multiple-contact plug and that has one or more mating contacts that, in a plugged-together state of the multiple-contact plug, each come into electrical contact with a respectively associated one of the contacts; and a short-circuit separating element situated on the mating plug, wherein the separating element, in the plugged-together state, displaces the primary locking lance of at least one contact from the protruding position into the deflected position, and interrupts the electrical contact between the primary locking lance and the contact surface of the at least one short-circuit bridge element.

15. The plug connector system as recited in claim 14, wherein the respective contact sensor is situated downstream from the undercut in the direction of insertion.

16. The plug connector system as recited in claim 14, wherein the at least one short-circuit jumper element covers a surface of the undercut at least in some regions.

* * * * *